US008850665B2

(12) United States Patent
Watrach

(10) Patent No.: US 8,850,665 B2
(45) Date of Patent: Oct. 7, 2014

(54) SLEEVE CIRCUMFERENCE REDUCER

(76) Inventor: Joseph Edward Watrach, Rosemont, IL (US)

( * ) Notice: Subject to any disclaimer, the term of this patent is extended or adjusted under 35 U.S.C. 154(b) by 426 days.

(21) Appl. No.: 12/931,378

(22) Filed: Jan. 31, 2011

(65) Prior Publication Data

US 2011/0290829 A1 Dec. 1, 2011

Related U.S. Application Data

(60) Provisional application No. 61/396,597, filed on May 28, 2010.

(51) Int. Cl.
*A41F 1/00* (2006.01)
*A41F 19/00* (2006.01)

(52) U.S. Cl.
CPC ..... *A41F 19/005* (2013.01)
USPC ..... 24/67.3; 24/67.9; 2/232; 2/269; 2/275

(58) Field of Classification Search
CPC ..... A41D 27/24; A41D 1/06; B42F 9/00; B42F 9/001; B42F 1/08; B42F 1/02
USPC ..... 24/531, 67.3, 67.9, 72.1, DIG. 29, 24/DIG. 28, DIG. 8, DIG. 10; 112/141, 147, 112/148, 150
See application file for complete search history.

(56) References Cited

U.S. PATENT DOCUMENTS 229,031 A * 6/1880 Campbell ..... 2/232
1,914,671 A * 6/1933 O'Neil ..... 40/641
2,124,049 A * 7/1938 Battista et al. ..... 47/47
2,567,602 A * 9/1951 Higgins ..... 224/231
2,938,252 A * 5/1960 Scheemaeker ..... 24/67.9
3,123,924 A * 3/1964 Roberts ..... 40/659
3,408,700 A * 11/1968 Marston ..... 24/67.3
3,950,823 A 4/1976 Schreter
4,148,114 A * 4/1979 Wier ..... 24/564
4,286,358 A * 9/1981 Levin ..... 24/67 R
4,372,998 A 2/1983 Shimada
4,384,417 A * 5/1983 Thompson ..... 40/659
4,766,613 A 8/1988 Wells
5,088,128 A 2/1992 Kape
5,170,535 A * 12/1992 Strong ..... 24/67.9
5,173,965 A 12/1992 Planner
5,606,777 A 3/1997 Lu
5,774,892 A 7/1998 Tisdale
5,787,511 A 8/1998 Garside
5,894,043 A 4/1999 Sood
6,408,438 B1 6/2002 McKee
6,618,862 B1 * 9/2003 Bunjes ..... 2/232
6,865,751 B1 3/2005 Brasher
6,973,700 B2 12/2005 Hsiao
7,174,608 B2 * 2/2007 Ching ..... 24/522
7,373,940 B1 5/2008 Lloyd
7,434,343 B2 * 10/2008 Yoshida ..... 40/666

(Continued)

*Primary Examiner* — Robert J Sandy
*Assistant Examiner* — Rowland Do
(74) *Attorney, Agent, or Firm* — Richard, Patent Law P.C.

(57) ABSTRACT

A clip for the construction of a temporary reduction of the seam of the sleeves of a short sleeve shirt, or the elastic cuffs of a long sleeve shirt. The clip creates a friction lock between the metal frame of the clip and the clip body with the material locked between the two parts of the clip. The clip creates a temporary seam or hem so that the shirt or other article of clothing appears tailored to accommodate medical prosthesis.

13 Claims, 4 Drawing Sheets

(56) References Cited

U.S. PATENT DOCUMENTS

| | | | | |
|---|---|---|---|---|
| 7,597,296 | B2 | 10/2009 | Conway | |
| 2005/0044610 | A1 | 3/2005 | Grimes | |
| 2005/0217078 | A1 * | 10/2005 | Groch et al. | 24/67.3 |
| 2007/0245460 | A1 | 10/2007 | Ryan | |
| 2007/0271683 | A1 | 11/2007 | McCrary | |
| 2009/0095207 | A1 | 4/2009 | Schlesinger | |
| 2010/0251459 | A1 | 10/2010 | Schlesinger | |

* cited by examiner

SLEEVE CIRCUMFERENCE REDUCER

CROSS REFERENCE TO RELATED APPLICATIONS

This present application claims the benefit under 35 U.S.C. §119(e) to U.S. Provisional Patent Application No. 61/396,597 (the "010 Application") which was filed on May 28, 2010 and entitled "Sleeve Circumference Reducer."

STATEMENT REGARDING FEDERALLY SPONSORED RESEARCH OR DEVELOPMENT

Not Applicable

BACKGROUND OF THE INVENTION

Clothing is generally mass produced in a variety of sizes. Most casual clothing can be purchased in a range of sizes, and may not require alteration. The problem with short sleeve shirts is that many short sleeve shirts that fit a person's torso do not always fit his/her arms (in circumference), and if he/she buys short sleeve shirts that fit the circumference of his/her arms, then it usually is too tight on his/her body. It is desirable to make the shirt highlight the right features of the person wearing the shirt. The present invention allows for a semi-custom fit around the bicep area of the sleeve; it allows a person to wear a shirt that fits his/her body while giving a semi-custom snug fit around the bicep, or around the chest area.

Another application is with long-sleeved shirts (an example is sweatshirts, but not limited to sweat shirts) that have elastic wrist material that has worn out from pulling the sleeves up and down, and/or being washed many times. Additionally, the invention is applicable to long-sleeved shirts if the elastic is too loose in the sleeves, or if the elastic becomes so stretched-out that it no longer fits properly. The present invention would allow a person to create a snug fit instantly.

While this is the preferred use of the invention, it can also be used to alter other parts of clothing which have, or can take, a seam. The invention can also be used to decorate laced shoes and other items with laces. The clip can be put on a baseball cap, to hold a women's scarf on her head, or on other miscellaneous items of clothing as an insignia, advertisement, or piece of jewelry.

Various devices are currently used in conjunction with clothing to create a seam or a tuck. For example, it is known art to attach a safety pin to a piece of clothing to hold it in place. However, such pins are not very attractive and can be difficult to attach if multiple folds or thick fabric is involved. Furthermore, the safety pins can often be seen, and the safety pin can also stick the person wearing the clothes, or someone else if he/she gets too close to the wearer of the short sleeve shirt. U.S. Pat. No. 3,950,823 uses a tie clasp to hold a tie close to the shirt of the wearer. Of course, a wide range of buttons and pins have been attached to clothing for decoration or identification of the wearer. Others have used a paper clip to create a temporary seam, but the paper clips can be seen by third parties and do not have a locking mechanism to keep the paper clip from being dislodged by the wearer's movements. Nor does a paper clip have a longer loop arm to assist with a tapered seam as is found on a short sleeve shirt or tee shirt.

Convertible garments are well known in the art. U.S. Pat. No. 5,088,128 discloses a drop-down cuff for trouser legs or sleeves. The cuffs are held in their raised positions by Velcro® pads or by stitching. U.S. Pat. No. 5,173,965 discloses a convertible shirt where the lower portion is provided with crystal beads or buttons which may be secured to an ornamental loop braid at the bottom of the upper portion or short skirt. U.S. Pat. No. 5,774,892 discloses converting trousers or shirts into shorts or short-sleeve shirts using a Velcro® strip. U.S. Pat. No. 4,766,613 discloses that a short-sleeve shirt may be converted to a long-sleeve shirt by using pile fasteners. U.S. Pat. No. 5,894,043 discloses a hem holding device for the temporary shortening and raising of a hem line of an article of clothing by the wearer of that clothing. Similarly, U.S. Pat. No. 5,787,511 also shows a temporary hemming device for the cuff of trousers. U.S. Pat. No. 6,865,751 B1 shows a method and apparatus for temporarily and decoratively altering clothing with a tie tack device. U.S. Pat. No. 6,408,438 discloses an adjustable length garment where the tubular additions may be secured to an adjacent upper portion by a zipper. U.S. Pat App 2007/0271683 A2 discloses a novel attachment for lengthening garments by using a clip to clip beads or other ornamentation onto an existing garment.

U.S. Pat. Application Nos. 2009/0095207 A1 discloses using a device to temporarily hem/cuff trouser legs, and U.S. 2010/0251459 A1 discloses using a compression circle to temporarily hem/cuff a pair of trouser's hems/cuffs.

U.S. Pat. No. 4,372,998 discloses using heat adhesive tape as the mechanism for holding the cuffed hem of a pair of trousers.

U.S. Pat. App. 2005/0044610 teaches that a garment may be provided with convertible ornamentation. U.S. Patent/Application 2007/0245460 discloses using a magnet and strip of metal to hold a pant leg away from the ground. U.S. Pat. Application No. 2007/0245460 teaches the use of a magnet and a piece of metal to adjust the length of a pair of pants.

U.S. Pat. No. 6,973,700 B2 discloses a new form of paper clip and discusses prior paper clips patents. U.S. Pat. No. 5,606,777 shows another form of clip for holding paper together.

U.S. Pat. No. 7,373,940 B1 discloses a hairstyling device with a comb-like bottom. U.S. Pat. No. 7,597,296 B2 discloses a clip used to hold onto a frame and clip on a piece of fabric, such as in a sign.

Another way of temporarily satisfying this need is to use clips known in the art, such as a paper clip, to form a temporary seam or hem. The use of such clips has been shown not to be effective. Most clips are designed to secure materials with generally thin, flat surfaces. The clips known in the art are not adapted to clip thick material such as multiple layers of tee shirt material. When thick material, such as multiple layers of shirt-sleeve material, are placed between the arms of a conventional paper clip, the paper clip generally fails to exert enough force to secure multiple layers of tee shirt material. Consequently, the paper clip will slide off the material as the wearer of the shirt moves around.

Accordingly, it is a general object of the present invention to provide (a) an improved temporary seam or hem that is easily adjustable; (b) a method of making such a seam/hem; and (c) a method of locking and unlocking the seam/hem. Another object of the present invention is to provide an easy way to make a temporary seam so that shirts will fit better around a prosthetic limb. The present invention could also be used to secure the hospital gown one is required to use in hospitals and doctors' offices.

A further object of the present invention is to provide uniquely configured and aesthetically pleasing ornamental designs to be worn on the rim/edge of a baseball cap, or on shoe laces as jewelry or for advertisement purposes.

BRIEF SUMMARY OF THE INVENTION

The object of the present invention is to provide a simplified and safe attachment mechanism for reducing the circumference of a shirt's short-sleeves around the bicep of the wearer. Another object of the present invention is to provide a way to obtain a snugger fit around the cuff of a long-sleeve sweatshirt, or a long-sleeve shirt with a similar elastic cuff. A further object of the present invention is to have a clip which will clip onto shoe laces as a form of decoration. Multiple embodiments of devices are disclosed for temporarily seaming/hemming shirts and taking into consideration the tapered shape of a tee shirt sleeve.

BRIEF DESCRIPTION OF THE SEVERAL VIEWS OF THE DRAWINGS

A complete understanding of the present invention may be obtained by reference to the accompanying drawings, when considered in conjunction with the subsequent detailed description, in which.

For purposes of clarity and brevity, like elements and components will bear the same designations and numbering throughout the FIGURES.

DETAILED DESCRIPTION OF THE INVENTION

Figure 1:
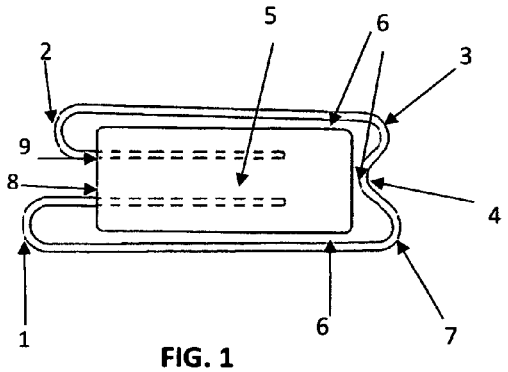
FIG. 1 is the view of the preferred embodiment of the invention as viewed looking down on top of the invention.

The present invention is directed to solving the problem of temporarily reducing the circumference around the bicep of a wearer of a shirts, i.e. tee shirt, knit shirt, golf shirt, tennis shirt, so that one who wants a snug fit around the bicep of a short-sleeve shirt can reduce the sleeve circumference with a temporary seam that can then be readily removed. Alternatively, the invention can be used on a sweatshirt shirt-sleeve with elastic sleeves that are too large, or that have become too large by wearing the sweatshirt. The present invention is also useful for one who has a medical prosthetic limb, and wishes for appearance or safety reasons to temporarily reduce the circumference of a shirt sleeve by making a seam or hem in the shirt-sleeve or other parts of clothing so that it appears more fashionable but also may provide for a safer fit that may keep the material from getting entangled in the movement of the prosthetic limb. The present invention could also be used to hold hospital gowns and medical gowns together, but still allow for quick release so the medical staff can open up the gown to conduct procedures on patients. The present invention can also assist one who is working around machines to make a temporary seam or hem to reduce clothing that may get caught in moving parts of a machine, or motor. Alternatively, the invention can be used to create a clip to fasten onto shoe laces, a baseball cap, or other kinds of clothing for ornamentation and advertisement.

The invention disclosed herein is, of course, susceptible to being embodied or conducted in many different manners. Shown in the drawings and described herein below in detail are preferred embodiments of the invention. It is to be understood, however, that the present disclosure is an exemplification of the principles of the invention, and does not limit the invention to the illustrated embodiments.

Referring to FIG. 1, in accordance with a preferred embodiment of the present invention, a view of the invention as viewed looking down on top of the invention. The body of the clip is constructed of plastic or more preferably thermoplastic material, 5; the remainder of the clip is metal or alternatively made from molded plastic and more preferably thermoplastic material. The metal in the clip has been bent at five locations, 1, 2, 3, 4, and 7. The bends at 3, 4, and 7 form the shape of a distorted letter "W." base. A longer arm, 1 through 7, is formed by using one of the legs of the "W" and making a "U" bend at 1. An inward bend occurs at 7; an outward bend at 4, and another inward bend at 3, thus forming a distorted "W" shape at the base of the clip. A "U" bend is made at 2 on the second leg of the W; and from 3 to 2 is the shorter arm of the clip. The wire at bend 1 and 2 enters the body of the clip at 8 and 9 and goes into the body of the clip about 40 to 80% of the length of the body of the clip. The metal wire can be in the range of 14 to 18 gauge stainless steel, but 16 gauge is the preferred wire gage.

The body of the clip can be a rectangular shaped six sided body, 5, with none of the edges of the body of the clip making contact with the wire or plastic frame around it at any place other than at the front of the body of the clip where the wire enters at 8, and 9. When used the clip body, 5, is placed on one side of the shirt material and the other side of the shirt material makes contact with the metal frame of the clip at parallel locations to the body of the clip, 6. The clip will hold the shirt material at three areas marked as 6, between the metal wire and the rectangular body, 5. Once the material is threaded between the clip body and the metal wire, then the body, 5, can be pushed so that the material will be caught at the three areas marked as 6. Note that the arm in FIG. 1 between the bend at 1 and 7 is longer than the arm between bends 2 and 3. This allows for the clip to be maneuvered or pushed so that the top of bend 1 will now touch the top of the outside seam of the shirt and create an illusionary seam which will accommodate for the difference in circumference of the sleeve of the shirt on the inner seam near the torso and outward seam near the elbow of the wearer. Note that the bend at 7 will be further away from the body of the clip at 5 than at bend 3. The "U" shape bend at 1 also allows one to grasp the clip with one's thumb and index finger to insert the wire frame on one side of the material and placing the clip body on the other side of the piece of folded material. The longer arm at bend 1 can be used to gain leverage to maneuver or push the clip at bend 1 into place along the seam of the outer seam of the shirt after the material of the shirt initially touches bend 2. Once the clip is in place one can push down on the clip body, 5, causing a friction lock of the material between the wire frame and the clip body.

Figure 2:
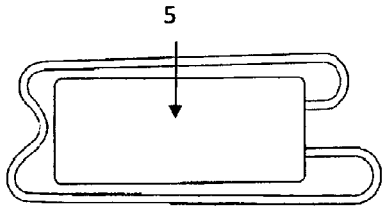
FIG. 2 is the view of the reverse of the preferred embodiment of the invention as seen after it is turned over onto the reverse side of the invention.

FIG. 2 is the view of the reverse of the preferred embodiment of the invention as seen after it is turned over end to end onto the reverse side of the invention. The body of the clip is shown on the reverse side as 5.

Figure 3:
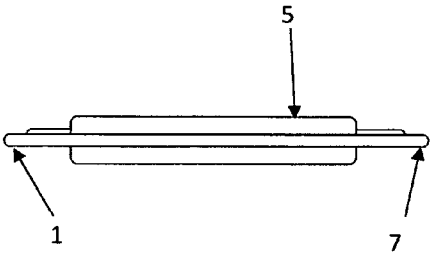
FIG. 3 is a side view of the preferred embodiment of the invention viewed with the invention lying flat.

FIG. 3 is a side view of the preferred embodiment of the invention viewed with the invention lying flat with the arm with the bends at 1 and 7 being the longer arm.

Figure 4:
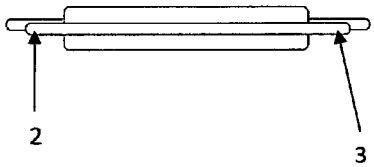
FIG. 4 is the opposite side view of the preferred embodiment of the invention.

FIG. 4 is the opposite side view of the preferred embodiment of the invention which shows the shorter arm between bends 2 and 3.

Figure 5:
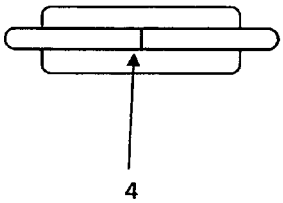
FIG. 5 is the end view of the preferred embodiment of the invention, where the clip is bent in the form of a triple bend in the form of the base of the letter "W."

FIG. 5 is the end view of the preferred embodiment of the invention where the clip is bent in the form of a triple bend in the shape of a distorted letter "W" base bend at 4 is shown.

Figure 6:
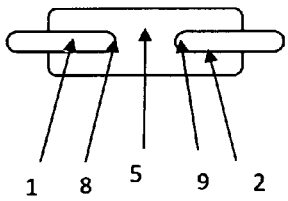
FIG. 6 is the opposite end view of the invention, where the metal clip parts are inserted into the body of the clip.

FIG. 6 is the opposite end view of the invention where the metal wire forms a "U" turn bends at 1 and 2 and then enters the body of the clip at points 8 and 9. The body of the clip is shown as 5.

Figure 7:
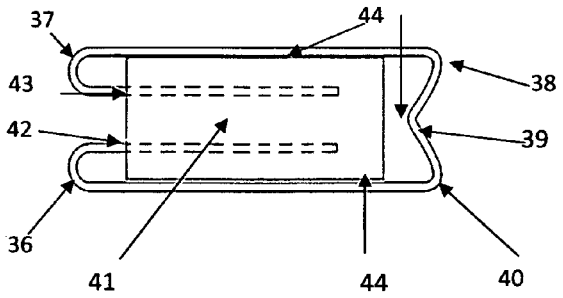
FIG. 7 is the view of an alternative form of the invention looking down from the top, which can be used on thicker clothing material, shoe laces and baseball caps.

FIG. 7 is the view of an alternative form of the invention looking down from the top which can be used on thicker clothing material, baseball caps or shoe laces. This clip has a body, 41, and tempered metal wire or plastic which is bent or molded to form the clip frame which follows the wire along points 36,40,39,38 & 37. The metal wire can be in the range of 14 to 18 gauge stainless steel, but the preferred gauge is 16 gauge stainless steel. The metal in the clip has been bent at five locations, 36, 37, 38, 39, and 40. An inward bend (U Shape) occurs at 36 and 37; an inward bend at 40 and 38 and an outward bend at 39. The bend at 38, 39 and 40 are in the shape of a base of the letter W. The wire ends enter the body of the clip at 42 and 43, respectively. The wire extends into the body of the clip between 40 and 80% of the body of the clip. The body of the clip can be a rectangular shape, six sided, or have different geometric shapes with a greater or fewer number of sides. None of the sides of the body, 41, will engage or touch the wire frame other than at 42, and 43. The clip body, 41, is placed on one side of the tee shirt material and the metal wire frame is placed on the other side of the material. The clip will hold the material at two or more areas marked as 44, between the metal wire and the rectangular body, 41. Once the material is threaded between the body and the metal wire, then the body, 41, can be pushed down so that the material will be caught at the two or three areas marked as 44. Note that the arms in FIG. 7 between the bend at 36 and 40 are the same length as between bends 37 and 38.

Figure 8:
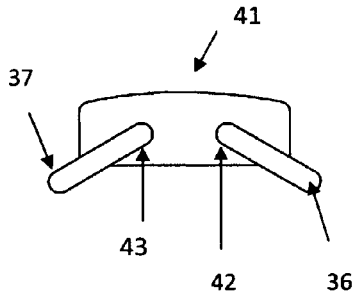
FIG. 8 is the view of an alternative form of the invention looking from the end view wherein the metal is inserted into the body of the clip.

FIG. 8 is the view of an alternative form of the invention looking from the end view wherein the metal is inserted into the body of the clip, 41. The legs of the "W" shape are shown twisted so that they lift the body of the clip, 41, away from the flat plainer surface of the wire frame. The wire points 43 and 42 enters the clip body at 41. The bends of the wire are reflected at points 37 and 36 respectively. The angle of the twisted rise of the body lifts the body away from the flat plain of the wireframe the angles can be 0 to 75 degrees as measured from outside the "W" arm to the upward twist of the U bend. The amount of the twist angle will depend on the thickness of the material to onto which the clip will be fastened or hooked.

Figure 9:
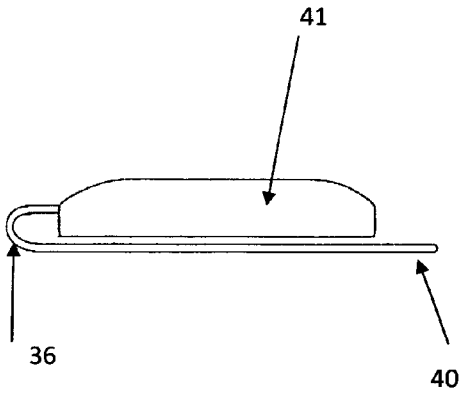
FIG. 9 is a side view of the alternative form of the invention for thicker material.

FIG. 9 is a side view of the alternative form of the invention for thicker material. The body of the clip is shown as 41. The U shape inward bend is shown as point, 36 which can be twisted between 20 to 75 degrees depending on the thickness of the material, but approximately 30 degrees from the flat plainer field of the W base at the distal end will accommodate most thicknesses of material. The opposite end of the wire with an inward bend at 40 is part of the W shape. The body 41 does not touch the wire frame other than where the wire enters the body frame.

Figure 10:
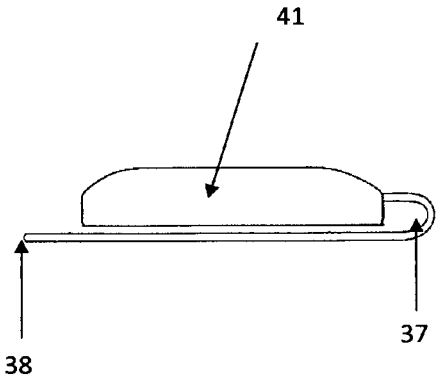
FIG. 10 is the opposite side view of the alternative form of the invention for thicker material.

FIG. 10 is the opposite side view of the alternative form of the invention for thicker material. The body of the clip is shown as 41. The inward W shape bend is shown as point 38. The opposite end of the wire with an inward bend at 37 can be twisted between 20 to 75 degrees depending on the thickness of the material, but approximately 30 degrees from the flat plainer field of the W base at the distal end will accommodate most thicknesses of material.

Figure 11:
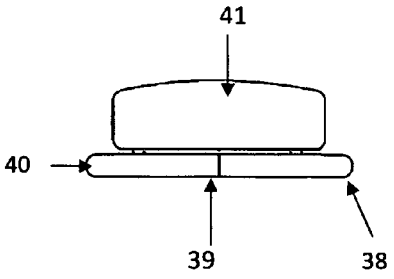
FIG. 11 is the view of an alternative form of the invention looking from the end view, wherein the metal is bent three times to form the base of the letter "W" part of the clip.

FIG. 11 is the view of an alternative form of the invention looking from the end view wherein the metal is bent three times to form the W shape of wire part of the clip at points 40, 39, and 38.

Figure 12:
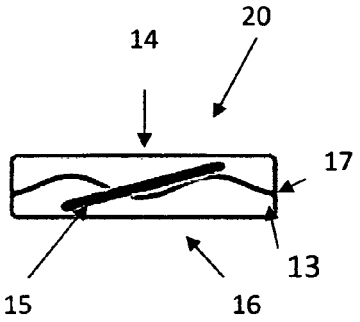
FIG. 12 is the view of a second alternative form of the invention, which is in a closed position and viewed from the metal spring end, which is inserted into the body of the clip according to the present invention.

FIG. 12 is a perspective view of the second improved alternative form of the invention, generally referred to as 20. This second alternative form of the invention has a multi sided upper arm which is shorter than the multi sided lower arm. The two arms are held together by a metal spring wire, 15. The upper arm of the invention is a multi-sided arm and in this embodiment has a top 14 and a bottom 13, but any number of sides of the upper arm are possible. The lower arm of the invention is a multi-sided arm and in this embodiment has a top 17 and a bottom 16, but any number of sides of the lower arm are possible as well. Viewing the invention from the front view as it would be inserted into the short sleeve shirt gathering of material above the seam, with the ridges on the bottom of the upper arm 13 and the multi sided lower arm in the preferred embodiment having ridges on the top of the lower arm which are offset to receive the ridges of 13 into 17. The ridged surface 13 and 17 are located to assist in the gripping of the excess shirt sleeve material which would be placed between 13 and 17. The tension spring metal/or plastic 15 holds the upper arm and the lower arm together.

Figure 13:
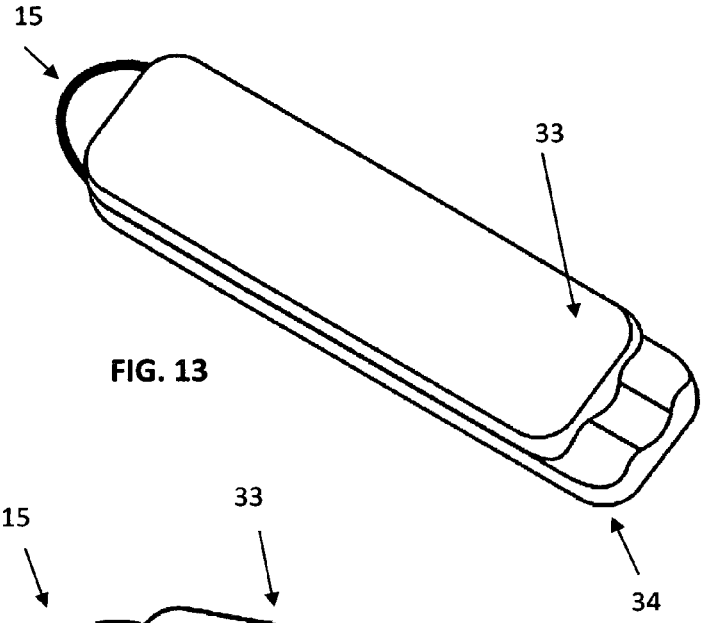
FIG. 13 is the view of the second alternative form of the invention looking down toward one side.

FIG. 13 is a perspective view of an alternative form of the invention in its open position as viewed from one side, the upper arm 33 being separated from the lower arm 34 by the connecting metal or plastic spring 15. The upper arm 33 is shorter than the lower arm 34.

Figure 14:
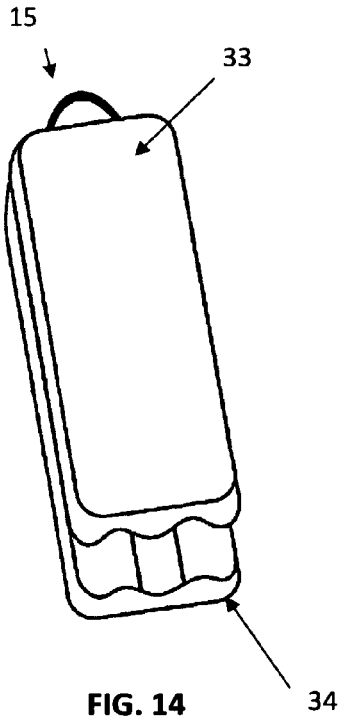
FIG. 14 is the view of the second alternative form of the invention looking down from the opposite end of the invention with the clip opened.

FIG. 14 is a perspective view of the second alternative of the invention in its open position with the upper arm 33 being shorter than the lower arm 34 with the metal or plastic spring, 15, holding the upper portion 33 and lower portion 34 of the invention together under tension.

Figure 15:
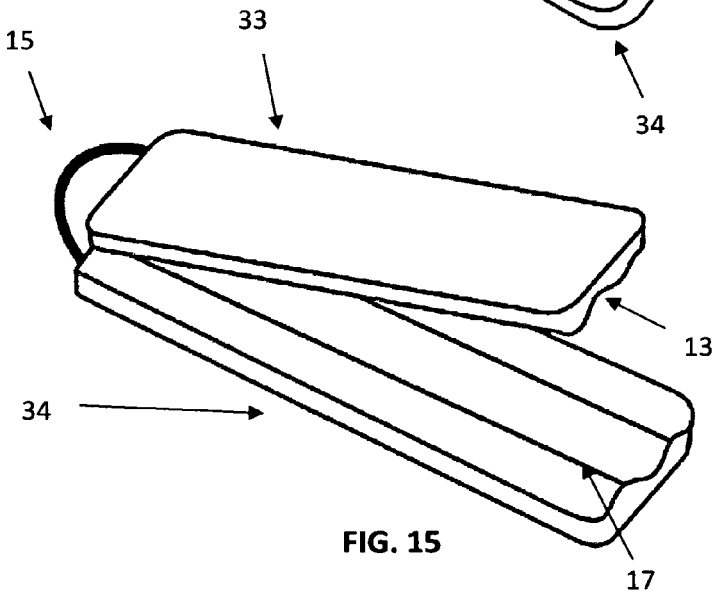
FIG. 15 is the view of the second alternative form of the invention with the upper arm of the clip opened.

FIG. 15 is a perspective view of the second alternative of the invention from the side view with the clip opened to show the upper arm 33 being shorter than the bottom arm 34 and being held together under tension by the metal spring 15. The top of the lower arm 17 shows a plurality of ridges to assist in holding the material of the shirt sleeve between the plurality of ridges on the bottom of the upper arm 13. The peaks and valleys of the ridges in 17 and 13 are machined to fit into each other's peaks and valleys.

Figure 16:
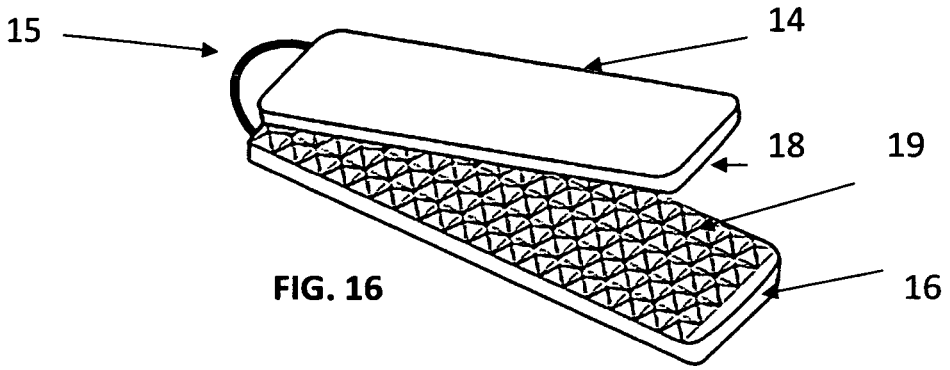
FIG. 16 is the view of the second alternative form of the invention with the upper arm of the clip opened and showing a pyramid clasping design on the top of the lower arm.

FIG. 16 is a perspective view of the second alternative of the improved clip of the present invention with a different pattern of a plurality of pyramid shaped teeth on the lower arm inside surface 19. The improved clip can have either a flat surface on the inside of the upper arm 18 or alternatively female teeth which will receive the male teeth in the top of the lower arm 19.

Figure 17:
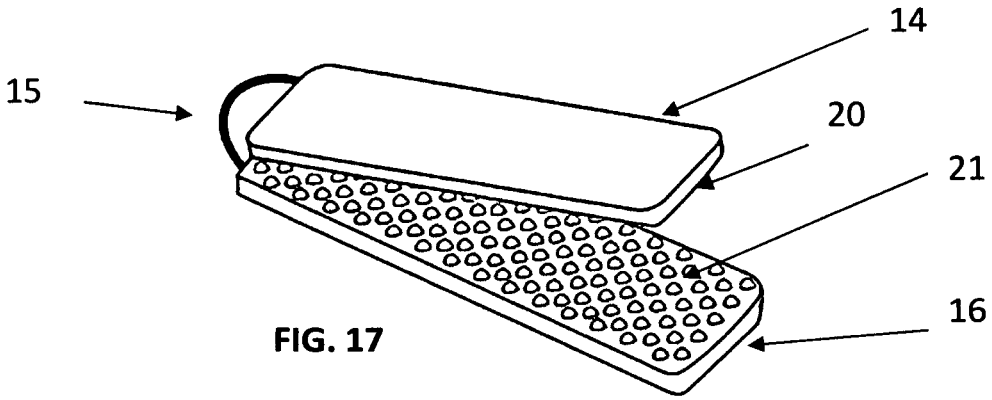
FIG. 17 is the view of the second alternative form of the invention with the upper arm of the clip opened and showing a rounded point clasping design on the top of the base.

FIG. 17 is a perspective view of the second alternative of the improved clip of the present invention with a different pattern of a plurality of raised points on the lower arm inside surface 21. The improved clip can have either a flat surface on the inside of the upper arm 20 or alternatively female teeth which will receive the male raised points into the female dimples in the underside of the upper arm 20.

Figure 18:
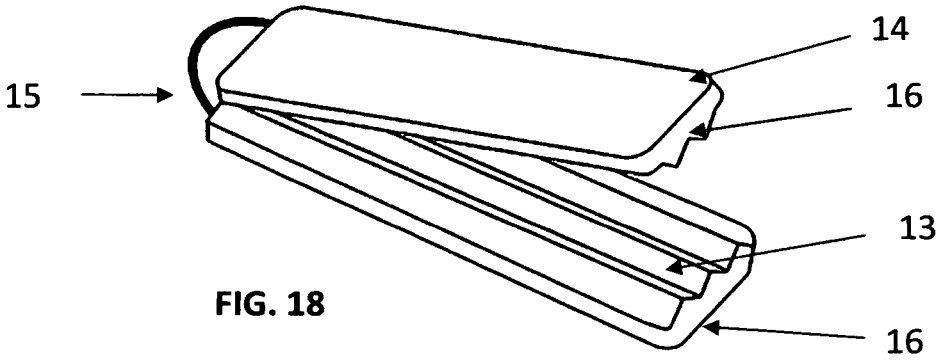
FIG. 18 is the view of the second alternative form of the invention with the upper arm of the clip opened and showing a longitudinal triangular clasping design in the top of the base plate.

FIG. 18 in a perspective view of second alternative of the improved clip of the present invention with a different pattern of latitudinal triangular shapes 13 which fits into the similar peaks and valleys of 17. The top of the upper arm is 14. The bottom of the lower arm is 16.

Figure 19:
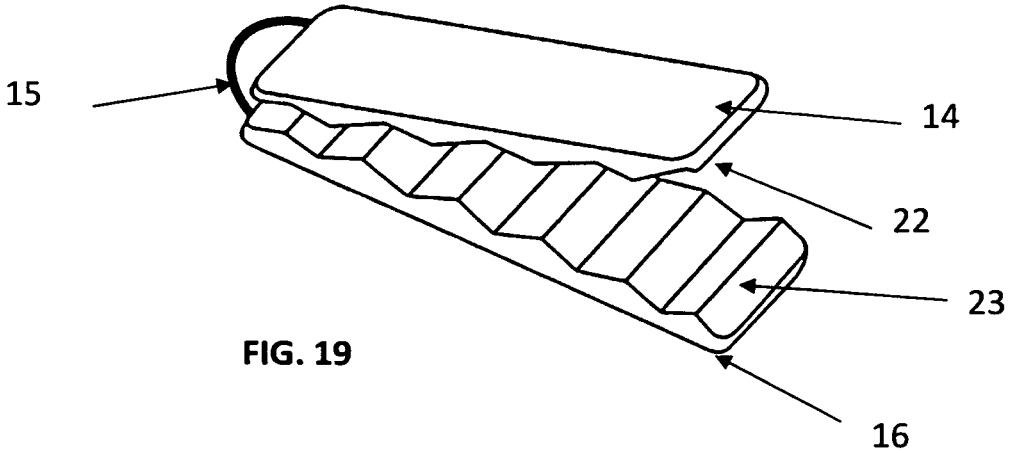
FIG. 19 is the view of the second alternative form of the invention with the upper arm of the clip opened and showing a cross-triangular clasping design in the top of the lower arm.

FIG. 19 in a perspective view of the second alternative of the improved clip of the upper arm is 14 and the inside of the upper arm with the cross triangular pattern 22 which matches the peaks and valleys of 23 which is on the lower arm. The bottom of the lower arm is 16.

The preferred embodiment of the invention wire frame in FIGS. 1-6 can be made from 16 gauge stainless steel wire, although wire 14 through 18 gauge could be used. Alternatively the frame could also be constructed from plastic material, and more preferably thermoplastic material. The preferred embodiment of the body of the clip will be constructed from plastic and more preferably thermoplastic material, e.g. ABS thermoplastic, which will encapsulate the wire as shown in FIG. 1 and FIG. 7.

If one doubles up the sleeve material near the under arm sleeve seam to the place where one wishes to establish the temporary seam, then if a person holds the material at the temporary seam location in the sleeve between the thumb and index finger of the one hand, and holds the material by the shirt sleeve seam with the other thumb and middle finger of the second hand one can then place point 7, as shown in FIG. 1, of the clip at the point one wishes to establish the temporary seam, one can then push the wire part of the clip on one side of the material while using the thumb of one of the hands to depress the body of the clip, 5, as shown in FIG. 1, on the other side of the material, and if simultaneously one pushes the clip toward bend 2 of the clip to the edge of the outer seam of the sleeve. When the shirt outer seam of the material is pressed up against bend 2 of the clip, then one can maneuver and pushes down on bend 7 and maneuver the clip toward the outer seam of the shirt and in the direction of the inner seam of the tee shirt. This maneuvering motion will lock the clip into place and so it is up against the outer seam of the shirt material. Thus the only part of the clip that will be readily visible to third parties will be Points 1 and 2 of the clip in FIG. 1.

Since the circumference of the sleeve on the typical tee shirt is two to three inches (five to seven and one half cm) narrower at the end nearer the elbow than near the torso of the human figure. This creates a tapered seam on the underneath of the arm. The inventor has determined that a better looking false, illusionary seam can be created by using a clip in the shape of FIG. 1, because when it is maneuvered and pushed to allow the bend at 1 in FIG. 1 to come in contact with the outer seam of the shirt or the widest part of the sleeve, then this will lock the material within the clip until it is maneuvered back and thus keep the clip from easily slipping off of the shirt. One can further lock the material by pressing down on the clip body, 5, against the material which will then create a friction lock with the wire frame at 6 in FIG. 1 and 44 in FIG. 7.

The preferred embodiment of the invention is nearly flat as shown in FIG. 1. For thicker material, the preferred embodiment is the clip in the form of FIG. 7. One may insert the clip into the material of the tee shirt as follows: take a shirt and lay it flat on a flat service, with the back of the tee shirt facing up toward the person wishing to insert the clip. Take the sleeve of the right arm; fold on the inside of the sleeve along the bottom seam of the sleeve the amount of material which one wishes to shorten the sleeve by doubling the material under the arm sleeve seam over and pulling the seam inward. With the longer arm of the clip, from bend 1 to 7 in FIG. 1, farther away from the seam of the sleeve, insert the material between the body of the clip, 5, on one side and the wire forming the bends at 7, 4 and 3 on the other side of the material and using the wire bend at 7,4, and 3 to grasp between ones thumb and index finger to assist in working the material up the wire frame. One may push with the top of bend 1 from FIG. 1 with one's index finger until the material is moved into the top of bend 2 of FIG. 1. At this point, one can then maneuver or push the clip toward the sewed seam of the sleeve until the top of bend 1 touches the top of the outer seam of the material. Then one can push the body, 5, of FIG. 1 so that the material is pressed between the three areas of 6 of the wire frame in FIG. 1, and thus it causes a temporary friction lock of the body, 5, and the material and the areas on the wire frame of the clip 6. Then one will have formed a tapered looking seam on the underside of the sleeve of the tee shirt which can be removed easily by releasing the pressure on the temporary friction lock between the body, 5, and the areas of the wire frame and the material. Thus, one is able to create an illusionary/false temporary seam, which can be easily removed by reversing the steps. Then one can do the same for the sleeve of the left arm, making sure that the longest arm, FIG. 1, 1 to 7, of the clip is furthest away from the folded material along the seam. The amount of overlap of the material should be approximately the same under both arms of the tee shirt for the average person, but can be adjusted as needed.

The inventor has found that if the material is thicker than tee shirt material, then the clip in the shape of FIGS. 7-11 is preferable to a clip in the shape of FIG. 1-6. Note the arms of FIG. 7 are the same length. Also note that the arms are twisted so that they are at an angle as reflected in FIG. 8 of between 20 to 75 degrees with 30 degrees being the preferred angle for most material thickness.

The preferred embodiment for placing the clip on shoe laces or baseball caps as a form of ornamentation or advertisement would be in the shape of FIG. 7. The design or advertisement can be placed on the body of the clip in a clip in the shape of FIG. 7, and for attaching the clip onto shoe laces and hat bands, then clips in the shape of FIGS. 7-11 is preferable. The clip in the shape of FIGS. 7-11 can be modified so that one has a rounded U shape, similar to a paper clip, instead of the W shape with the bends 38, 39, and 40 of FIG. 7. Or alternatively, the base could have only two bends of 90 degree angles to each other and be rectangular in shape. In the alternative, the base could have a half circular arch instead of the W shaped three bends. In an alternative method of making the clip, the wire form could be replaced by a thermo plastic in an injection molding process which would make the form for the clip and clip body at the same time in one or more steps.

The use of a paper clip for the same purpose as described above will not allow one to lock the clip onto the shirt sleeve material in a temporary friction lock by pushing the body of the clip, 5 in FIG. 1 or 41 in FIG. 7, inwardly as can be done with the invention as shown in FIG. 1 or FIG. 7. Nor can one obtain the tapered look that can be accomplished with the invention in FIG. 1 by maneuvering the clip after the bend at 2, of FIG. 1, has made contact with the material so that the bend at 1 of FIG. 1 will also touch the outer seam of the shirt.

Painting the wire surface of the frame of the clip or adding rubber to the surface of the wire frame of the invention for FIGS. 1-11 would also increase the friction between the wire frame of the invention and the material of the shirt, or scarf in which one is wishing to place a temporary seam or hem. This is also important when the clip is being used to hold clothing out of the way of moving parts of machinery.

Any type of rubber material known in the art can be used with the present invention. For example, thermoplastic elastomer, thermoplastic urethane or thermoplastic rubber can be used with the present invention. In particular, commercially available thermoplastic materials such as SANTO-PRENE® or PELLETHANE® can be used with the present invention.

In the second alternative embodiment, the upper arm, metal spring and lower arm would be stamped or molded from one piece of metal or plastic. Then it would be dipped in a rubber coating or sprayed with a foam application to ensure the material would not slide out of place. The material would then be bent into place to finish the process of manufacturing of the clip.

The invention provides a person the ability to reduce the circumference of their short sleeves with nearly no detection of the invention when wearing the tee shirt or long sleeve shirt. One would first fold the sleeve inward on the seam then slide the material in between pieces 33 and 34 of FIG. 15. After the material is secured with the amount of fabric reduced, the excess fabric will be folded and hidden inside of the sleeve. The invention having a smooth outside will make it comfortable for the wearer of the garment.

All of the various embodiments of the invention shown in FIGS. 1-19 will be lightweight and will hold the material firmly. The clip will also be very thin and nearly undetectable when worn.

The invention may be used to create an illusionary seam in other locations in a tee shirt, such as in chest area for women and men. The invention may also have applications in other pieces of clothing such as in the theater for costumes or for children clothes in the waist or hem of trousers of young children who are growing quickly.

The length of the invention can be from one to four inches (2½ to 10 cm) depending on the sleeve length or other articles of clothing. The preferred embodiment of the invention, FIGS. 1-6, should be no wider than one eighth to one half inches (0.5 to 1.3 cm). The height of the preferred embodiment will be minimal and nearly flat when locked into place, and ideally would be ⅛ to no more than ⅜ of an inch (0.3 to 1.3 cm).

The invention can be made in various colors to match skin tones, clothing colors or clear if made out of plastic.

The foam, plastic or rubber placed on the stamped metal piece in the second alternative FIG. 12-19 will assist in holding the sleeve material. Tension on the spring can be used to lock the sleeve material into place, but one can also use fasteners, pins and magnets at the end opposite the metal.

In the alternative the invention can be made so that there will only be four inward bends which would eliminate the outward bend in the middle. Further, if the wire frame of the clip is made with four inward bends the second and third bends can be at right angles to each other or alternatively the second and third bends could create a half circle.

Men will be able to get a custom fitted look to their tee-shirts and gain the perception of a larger arm due to the snug fit of the tee-shirt around their biceps. Women will also be able to enjoy the same instant semi-custom shirt.

The present invention is discussed in the context of seams of tee shirts, wearing with baseball caps and on shoe laces, but the invention can also be used with any other material or fabric. Preferred embodiments of this invention are described herein, including the best mode known to the inventor for carrying out the invention. Variations of those preferred embodiments may become apparent to those of ordinary skilled in the art upon reading the foregoing description. The inventors expect skilled artisans to employ such variations as appropriate, and the inventors intend for such the invention to be practiced otherwise than as specifically described herein. Accordingly, this invention includes all modifications and equivalents of the subject matter recited in the claims appended hereto as permitted by applicable law. Moreover, any combination of the above described elements in all possible variations thereof is encompassed by the invention unless otherwise indicated herein or otherwise clearly contradicted by context.

I claim:

1. A clip for creating a seam in clothing, comprising:

a cuboid body including a top face, a bottom face, wherein the top face and the bottom face are connected by four side faces forming a perimeter of the body;

a wire including a first end and second end both extending from a first side face of the body, wherein the wire surrounds at least a portion of the perimeter of the body, wherein the first end includes a first U-shaped bend and the second end includes a second U-shaped bend, wherein the first U-shaped bend extends farther away from the first side face than the second U-shaped bend, wherein the wire partially surrounds the first side face and wherein the wire surrounds three side faces of the four side faces.

2. The clip of claim 1 wherein the wire includes a first point and a second point, wherein the first point extends away from a second side face farther than the second point extends away from the second side face, wherein the second side face is opposite from the first side face of the body.

3. The clip of claim 1 wherein the top face and bottom face are rectangular shaped.

4. The clip of claim 1 wherein the wire is made of 16 gauge stainless steel wire.

5. The clip of claim 1 wherein the body is made of plastic.

6. The clip of claim 1 wherein the wire only contacts the first side face.

7. The clip of claim 1 wherein the wire is secured within the body between the top face and bottom face of the body.

8. A clip comprising:

a rectangular cuboid body including a front face, a back face, a left side face, and a right side face, wherein the left side face and the right side face define the length of the body; and a wire including a first end and a second end, wherein, starting from the first end of the wire, the wire:

extends from the front face making a first U-shaped bend;

extends alongside the left side face past the length of the body forming a first, straight, side segment;

curves from the left side face to the right side face along the back face;

extends alongside the right side face past the length of the body forming a second, straight, side segment; and makes a second U-shaped bend to connect to the front face, wherein the first U-shaped bend extends further from the front face than the second U-shaped bend.

9. The clip of claim 8 wherein the first, straight, side segment is longer than the second, straight, side segment.

10. The clip of claim 8 wherein, as the wire curves from the left side face to the right side face along the back face, the wire forms a first curve and a second curve, wherein the first curve extends farther from the back face than the second curve.

11. The clip of claim 8 wherein the wire is made of 16 gauge stainless steel wire.

12. The clip of claim 8 wherein the body is made of plastic.

13. The clip of claim 8 wherein the wire only contacts the front face.

* * * * *